US005994037A

United States Patent [19]

Twist et al.

[11] Patent Number: 5,994,037

[45] Date of Patent: Nov. 30, 1999

[54] METHOD FOR RAPID PHOTOGRAPHIC PROCESSING WITH MAINTAINED COLOR BALANCE USING DIFFUSIBLE PHOTOCHEMICALS

[75] Inventors: Peter J. Twist, Gt. Missenden; John D. Goddard, Pinner, both of United Kingdom

[73] Assignee: Eastman Kodak Company, Rochester, N.Y.

[21] Appl. No.: 09/176,529

[22] Filed: Oct. 21, 1998

[51] Int. Cl.[6] ..... G03C 7/407

[52] U.S. Cl. ..... 430/382; 430/380; 430/445; 430/446; 430/468; 430/469; 430/478; 430/487; 430/963

[58] Field of Search ..... 430/380, 382, 430/445, 446, 468, 469, 478, 487, 963

[56] References Cited

U.S. PATENT DOCUMENTS

| | | | |
|---|---|---|---|
| 4,155,763 | 5/1979 | Hasebe et al. | 430/469 |
| 4,266,002 | 5/1981 | McCreary et al. | 430/218 |
| 4,394,440 | 7/1983 | Cappel | 430/379 |
| 4,465,762 | 8/1984 | Ishikawa et al. | 430/376 |
| 4,483,919 | 11/1984 | Kobayashi et al. | 430/566 |

FOREIGN PATENT DOCUMENTS

| | | |
|---|---|---|
| 0 561 860 B1 | 11/1995 | European Pat. Off. . |
| 62-178 251 | 8/1987 | Japan . |

*Primary Examiner*—Hoa Van Le
*Attorney, Agent, or Firm*—J. Lanny Tucker

[57] ABSTRACT

Color photographic elements, especially color photographic papers, can be more rapidly color developed (up to 25 seconds) in the presence of a color developing solution containing a selectively diffusible color development photochemical such as a development inhibitor. Despite the shortened processing time, color balance within the three color records of such elements is maintained. The selectively diffusible color development photochemical has size and structure that enables it to have sufficient solubility in the color developing composition, and to selectively diffuse into the topmost red-sensitive emulsion layers of the processed color papers only.

20 Claims, 4 Drawing Sheets

METHOD FOR RAPID PHOTOGRAPHIC PROCESSING WITH MAINTAINED COLOR BALANCE USING DIFFUSIBLE PHOTOCHEMICALS

COPENDING APPLICATIONS

Copending and commonly assigned U.S.S.N. 09/76,503, filed on even date herewith by Twist, and entitled "A Method for Rapid Photographic Processing with Maintained Color Balance".

FIELD OF THE INVENTION

This invention relates to a method of processing color photographic papers in a rapid fashion without loss in color balance among the color records.

BACKGROUND OF THE INVENTION

Multicolor, multilayer photographic elements are well known in the art. Such materials generally have three different selectively sensitized silver halide emulsion records coated on one side of a single support. Each color record has one or more silver halide emulsion layers having components useful for forming a particular color in an image. Typically, the materials utilize color forming couplers or dyes in the sensitized layers during processing.

One commercially important type of color photographic elements is what is known as color prints. These elements are used to display images captured by a camera user on photographic color negative films. There is a continuing interest in the industry to provide color print images more rapidly so the customers have a smaller wait from the time the color negative films are submitted for processing to the time they receive the color prints.

In color paper processing, the conventional order of the light sensitive color records on a support is a blue-sensitive silver halide emulsion layer nearest the support, a green-sensitive silver halide emulsion layer next to it, and a red-sensitive silver halide emulsion layer as the topmost light sensitive layer. It has been observed that the blue-sensitive emulsion layer is the slowest to achieve aim sensitometry, generally because it is the last layer to receive processing chemicals. Most color papers are designed in the various layers to take this into account and to provide desired correct color balance among the color records using standard processing conditions and times.

However, as noted above, there is a need to reduce processing time, and particularly to reduce color development time. When conventional color papers are color developed in reduced times, for example, less than 25 seconds, the red-sensitive color record is generally over developed and the blue-sensitive color record is underdeveloped. Reformulation of the conventional color developer chemicals to decrease activity in the red-sensitive color record towards the aim sensitometry only makes the blue-sensitive color record move lower and further from aim sensitometry. Reformulation of the conventional color developer chemicals to increase activity in the blue-sensitive color record towards aim sensitometry only makes the red-sensitive record move higher and further from aim sensitometry. Thus reformulation of the conventional color developer chemicals has not resulted in a solution to the problem and for short color development times, existing color papers give prints with unacceptable color balance. It is not practical to change the color papers for photoprocessing, especially since a photoprocessing customer will be processing from several manufacturers.

Thus, there is a need to provide aim color balance in color photographic silver halide papers without reengineering the color papers or adversely affecting the color developing composition, no matter what time is used for color development. In particular, it is desired to achieve aim color balance during rapid color development.

SUMMARY OF THE INVENTION

An advance in the art is provided with a method of forming a color photographic image comprising:

A) contacting an imagewise exposed color silver halide photographic element with a color developing composition comprising a color developing agent, and a selectively diffusible color development photochemical at a concentration of at least 0.05 mmol/l, the contacting being for up to 25 seconds, the photographic element comprising a support having thereon a blue-sensitive photographic silver halide emulsion layer, a green-sensitive photographic silver halide emulsion layer, and a red-sensitive photographic silver halide emulsion layer, the selectively diffusible color development photochemical having a diffusibility such that during the contacting step, it diffuses predominantly within the outermost silver halide emulsion only.

It was surprising that incorporating a particular selectively diffusible color development photochemical, such as a color development inhibitor, into the color developing composition provided desired color balance and sensitometric properties in photographic color papers even when color development is carried out within the short time of 25 seconds or less. The blue-sensitive emulsion layers (or color record) are appropriately developed and the outermost red-sensitive emulsion layers (or color record) are not overdeveloped.

The color records of the processed photographic element are selectively affected by the controlled diffusion of the selectively diffusible photochemical into the element with respect to time. This photochemical is sufficiently soluble in the color developing solution, but at the same time it is sufficiently bulky (molecular weight) to diffuse predominantly only into the outermost silver halide emulsion layer (s) or red-sensitive color record in the case of most color papers. This is what is meant by "selectively diffusible". This controlled diffusibility can be achieved by carefully choosing the structure and molecular weight of the photochemical.

It is well known that the diffusion of a compound in photographic materials can be controlled using bulky ballasts or anchors. However, usually the ballast moieties are so hydrophobic that their attachment to photochemically active molecules severely diminishes the compound's solubility in aqueous photographic processing solutions.

It is also well known that the solubility and diffusibility of a color development photochemical in aqueous media can be increased by the incorporation of certain functionalities such as carboxylic acid ($—CO_2H$), sulfonic acid ($—SO_3H$), alkylammonium [$—N(R)_3^+$] and arylammonium [$—N(Ar)_3^+$] groups. Unfortunately in some cases, such functionalities can have deleterious consequences on the photographic performance of the color development photochemical. For example, in the case of a color development inhibitor, increasing its solubility in aqueous media beyond a certain limit can render the photochemical inactive as an inhibitor of color development and indeed in some cases, it can even produce a compound that is an accelerator of color development instead of being an inhibitor.

It is therefore a difficult problem in photographic chemistry to design photochemicals that have a combination of features such as photographic activity in the desired sense, adequate solubility in aqueous media and steric bulk to selectively limit diffusion. Normally some or all of these features are mutually exclusive, as noted above.

The present invention overcomes these difficulties with the photochemicals described herein. Thus, color balance is achieved with more rapid processing of color photographic elements, such as color papers, without changing the elements themselves, and without considerable reformulation of the color developing composition.

The present invention particularly provides for effective and rapid color development of current or commercially available photographic color papers. Thus, the current commercial color silver halide papers can be processed using either the conventional processing or the rapid process of this invention.

DETAILED DESCRIPTION OF THE INVENTION

Figure 1:
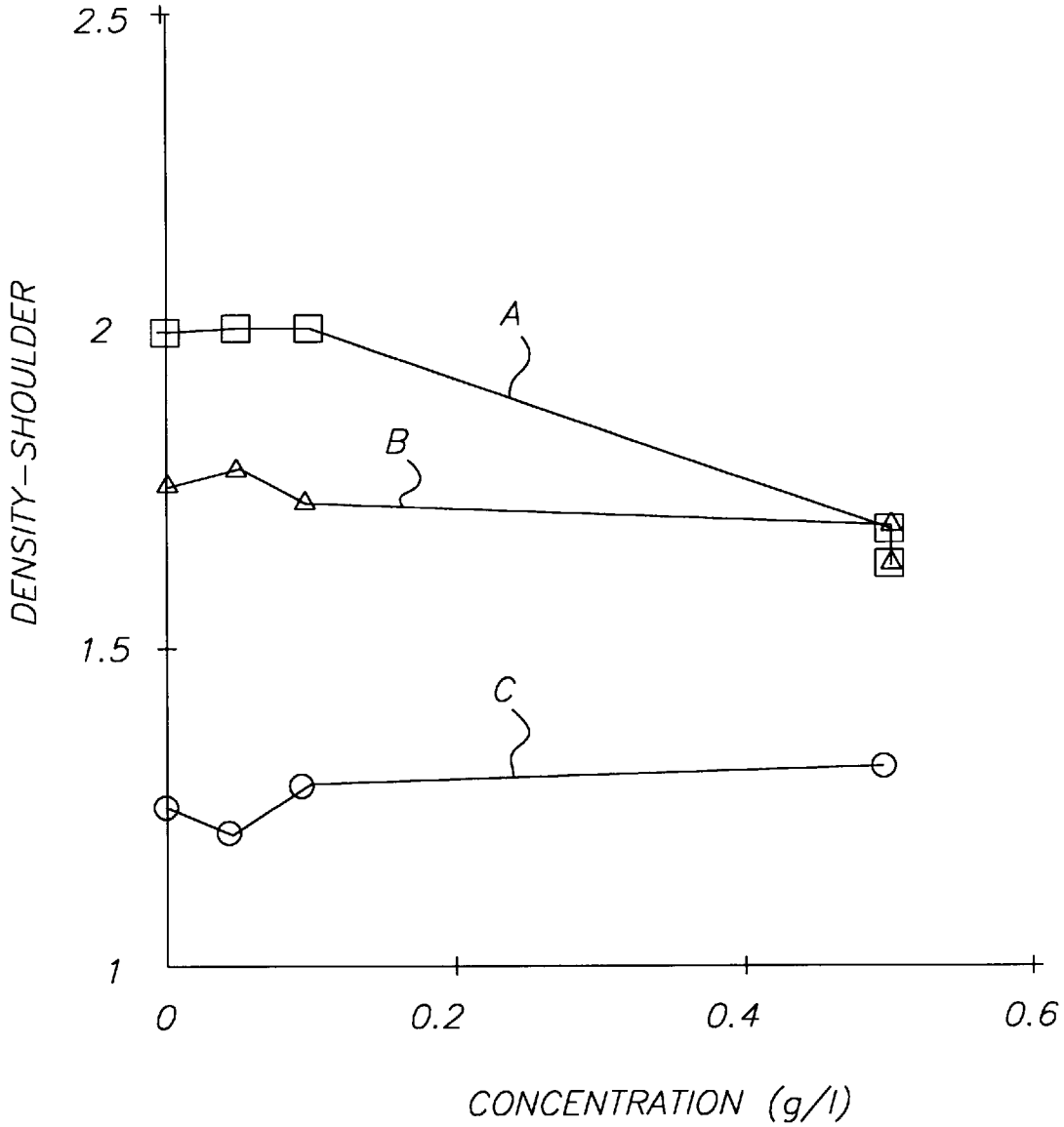
FIG. 1 is a graphical plot of sensitometric results in the color records of the processed color papers as described in Example 1 below.

Various color development photochemicals can be made selectively diffusible and used according to the present invention. Preferably, such photochemicals are color development inhibitors as defined below. Alternatively, they can be color development accelerators having a color development accelerating moiety attached to the bulky part of the molecule. Still further, the photochemicals can be carefully crafted color developing agents that diffuse selectively into the outermost silver halide emulsion layer(s), and have a color developing moiety attached to the bulky part of the molecule.

The color development photochemicals useful in this invention can be represented generally by the structure I:

$$\text{CDUG—LG—LINK—(LG—CDUG)}_q \qquad \text{I}$$

wherein CDUG represents a "color development useful group" that provides the -chemical activity (for example, color development, color development inhibition, or color development acceleration) desired in photoprocessing, LG is a chemical bond or a divalent chemical group that bonds CDUG to a linking group LINK and q is 0 to 4 (preferably, q is 0 or 1). The preparation of such compounds would be readily apparent to one skilled in the art.

Where CDUG is a color developing moiety, it can be derived from color developing agents such as substituted p-phenylenediamines. Such compounds are well known in the art as described for example in U.S. Pat. No. 3,574,619 (Surash), U.S. Pat. No. 4,170,478 (Case et al), U.S. Pat. No. 4,482,626 (Twist et al), and U.S. Pat. No. 4,975,357 (Buongiorne et al), and *Research Disclosure*, publication 38957, pages 592–639 (September 1996, and publications cited therein in Section XIX.A.), the disclosures of all of which are incorporated herein by reference. *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*".

Where CDUG is a color development accelerator moiety, it can be derived from substituted 1-phenyl-3-pyrazolidones, p-aminophenols, thioethers or aminoalcohols. Such compounds are well known in the art as described for example in U.S. Pat. No. 4,170,478 (noted above, for p-aminophenols), U.S. Pat. No. 4,394,440 (Cappel, for aryl-3-pyrazolidones) and U.S. Pat. No. 5,633,124 (Schmittou et al, for thioethers), and Research Disclosure (noted above, Section XIX.A.), the disclosures of all of which are incorporated herein by reference.

In preferred embodiments, the selectively diffusible photochemical is represented by structure II wherein INM represents moieties derived from development inhibiting chemicals:

$$\text{PNM—LG—LINK—(LG—INH)}_q \qquad \text{II}$$

Generally, INH is derived from heterocyclic compounds having one or more nitrogen, sulfur, oxygen, selenium or tellurium atoms in the heterocyclic ring(s). INH may also be derived from such heterocyclic compounds wherein the heterocyclic ring(s) bear at least one exocyclic mercapto (—SH), seleno (—SeH) or telluro (—the) group or at least one exocyclic derivative of a mercapto, seleno or telluro group.

LG can be a variety of chemical groups that attach INH to LINK in Structure II (and CDUG to LINK in Structure I). For example, LG can be, but is not limited to, carbonamido (—CONH—), carbamoyl (—NHCO—), sulfonamido ($—SO_2N—$), sulfamoyl ($—NSO_2—$), an ester ($—CO_2—$), oxycarbonyl [—OC(=O)—], ether (—O—), thioether (—S—), selenoether (—Se—), telluroether (—Te—), ureido (—NHCONH—), amino (—NH—), hydrazido (—CONHNH—), or carbamate ($—NHCO_2—$). Such chemical groups can be directly attached to INH or they can be attached through a straight or branched, substituted or unsubstituted alkylene group having 1 to 8 carbon atoms (such as methylene, ethylene, isopropylene and n-hexylene), or a substituted or unsubstituted aryl or heterocyclyl group.

In structure II, q is 0 to 4, and preferably it is 0, 1 or 2. More preferably, q is 0 or 1.

For example, INH can be derived from substituted or unsubstituted heterocyclic compounds that include, but are not limited to, substituted or unsubstituted oxazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, tellurotetrazoles or benzisodiazoles, or other substituted or unsubstituted compounds that would be readily apparent to one skilled in the art.

Particularly useful INH groups can be one of the following heterocyclyl groups:

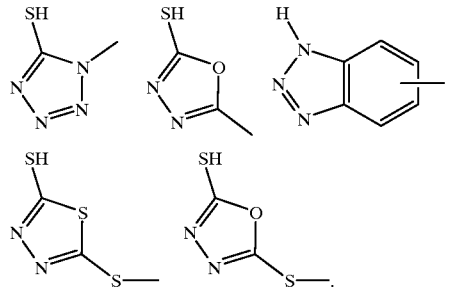

In both structures I and II, LINK is a monovalent to pentavalent moiety (preferably divalent) that provides the desired controlled diffusibility. The LINK group is sufficiently bulky to limit diffusion of the photochemical to the outermost red-sensitive emulsion layers, but yet provide desired solubility in the color developing solution. LINK can be any suitable aliphatic group having at least 5 atoms (carbon, nitrogen, oxygen and sulfur atoms) in a chain, and can include one or more cyclic groups linked to each other or together with one or more acyclic groups. Generally, such groups comprise one or more branched or linear alkylene groups (each having 1 to 6 carbon atoms) that are linked by one or more oxygen, nitrogen or sulfur atoms (that can be substituted as well). More preferably, such alkylene groups are methylene or ethylene groups. Generally, LINK has a molecular weight of from about 88 to about 5000, and preferably from about 220 to about 880.

In one embodiment, the selectively diffusible development inhibitor can be represented by the structure III:

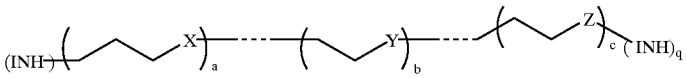

wherein X, Y and Z represent oxygen, nitrogen or sulfur atoms connected to ethylene groups in the subunits identified in the parentheses, and q is as defined above (but q is preferably 0 or 1). The total number of these subunits is the sum of a, b and c, which can vary from 3 to 33, and is preferably from 10 to 20. Most preferably the sum is 14. One particularly useful UNK is represented by structure III wherein each of X, Y and Z is oxygen, and the sum of a, b and c is 14.

Representative development inhibitors useful in the practice of this invention include, but are not limited to,

C1

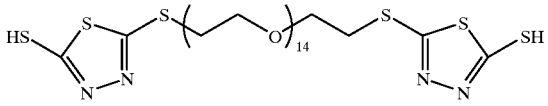

C2

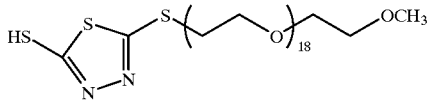

C3

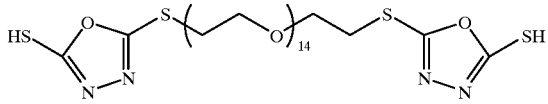

C4

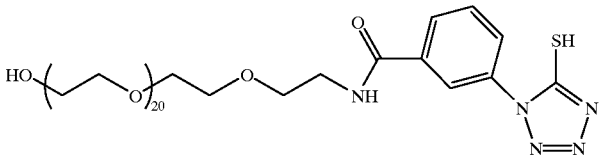

C5

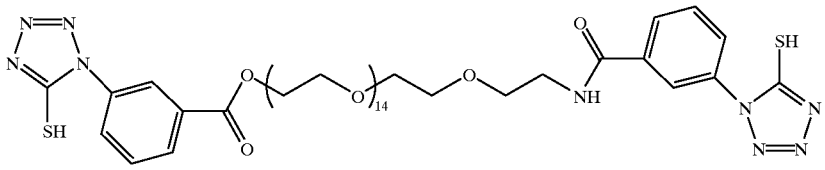

-continued
C6
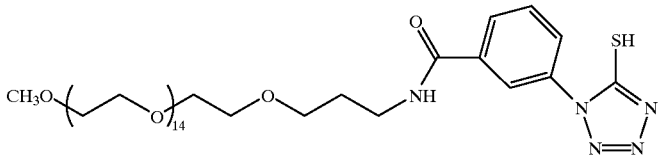
C7
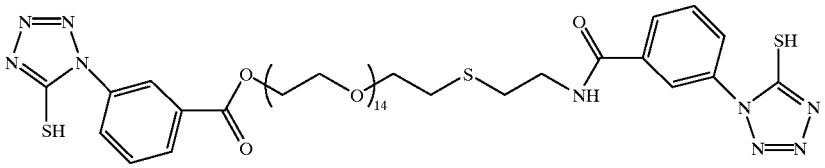
C8
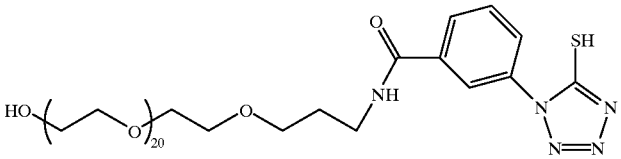
C9
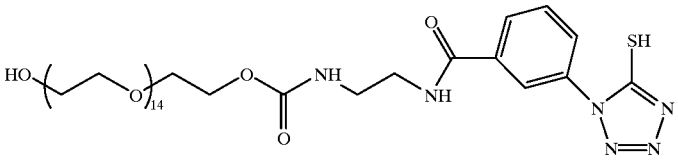
C10
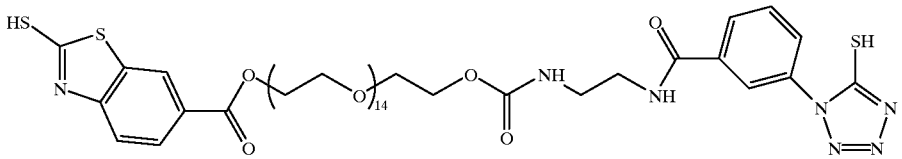
C11
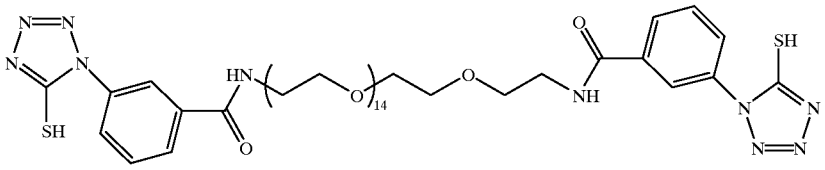
C12
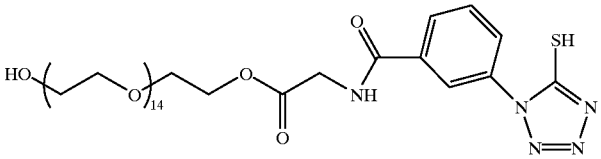
C13
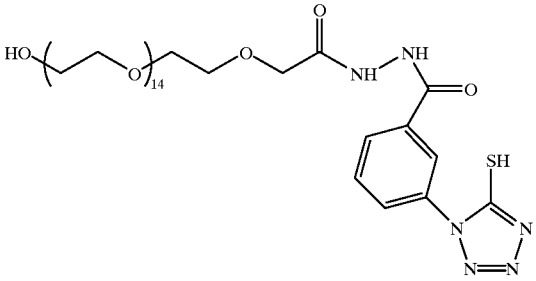

-continued
C14
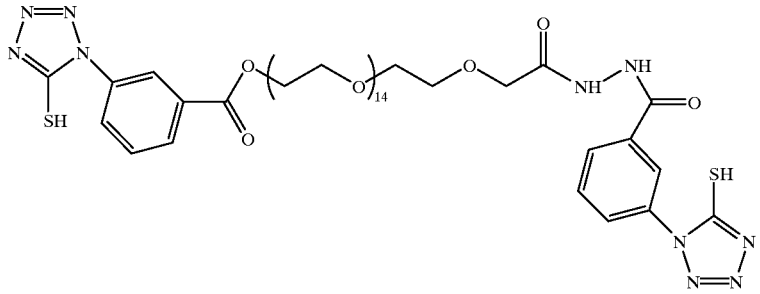
C15
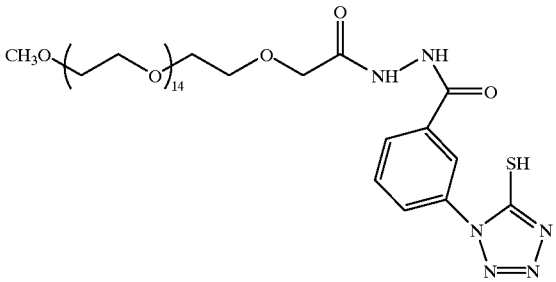
C16
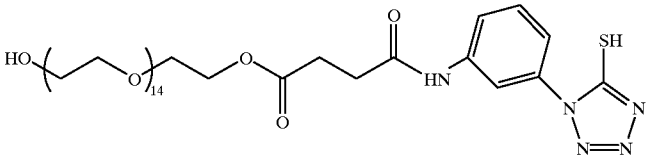
C17
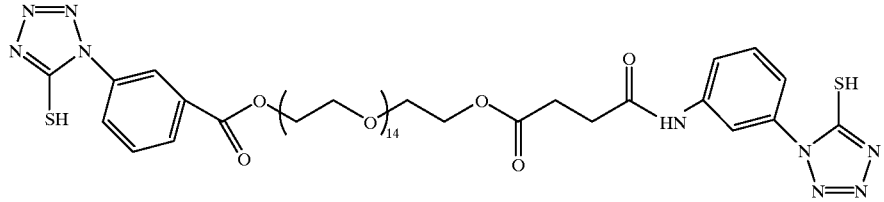
C18
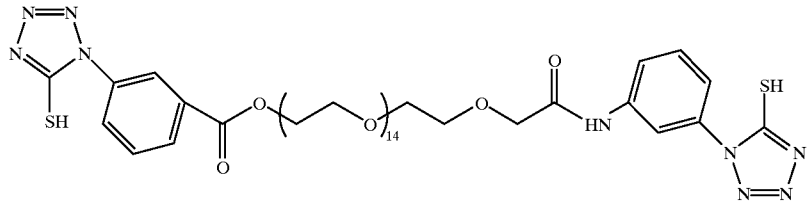
C19
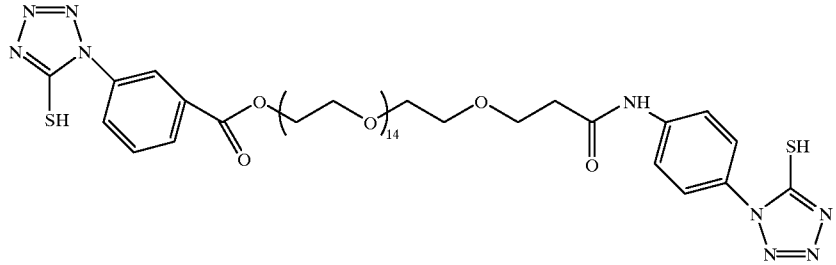

-continued
C20
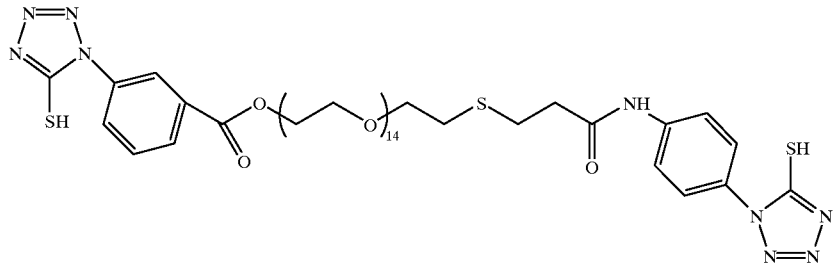
C21
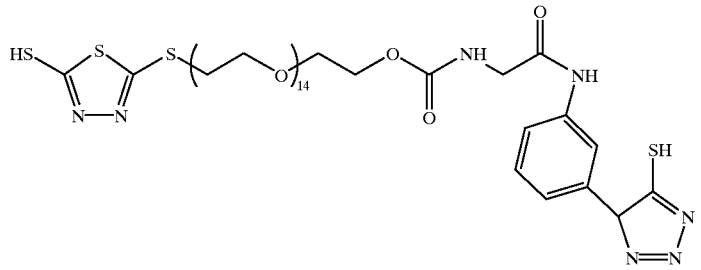
C22
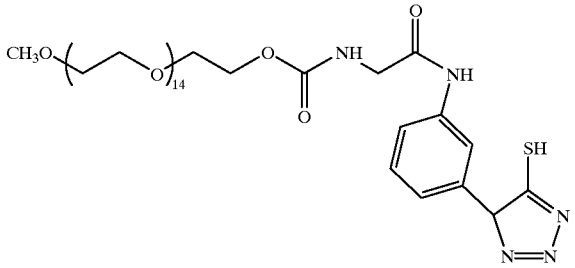
C23
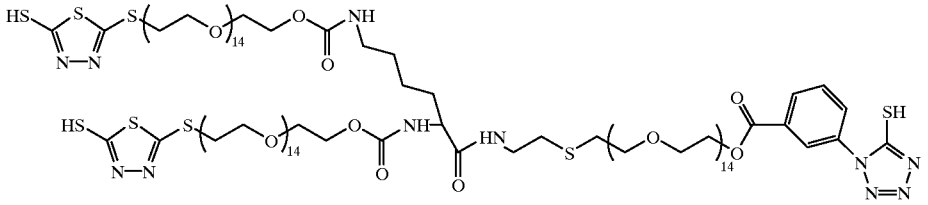
C24
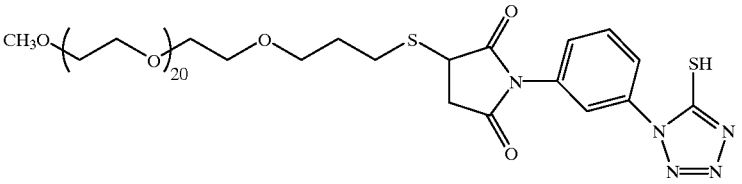
C25
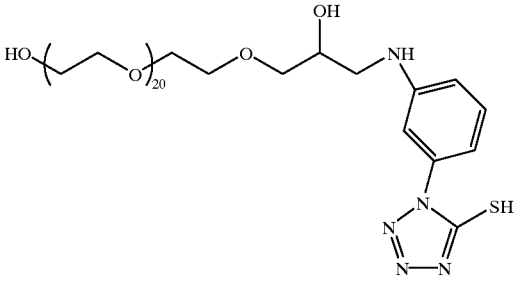

-continued

C26

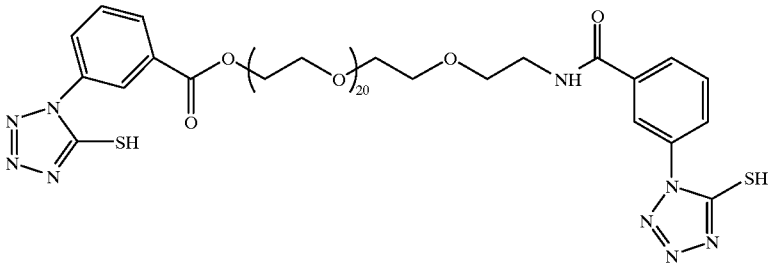

C27

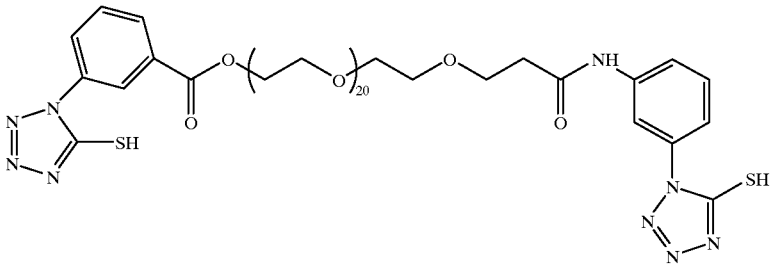

C28

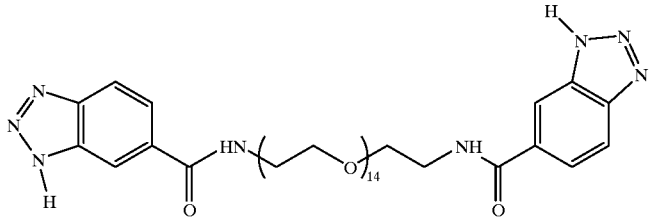

C29

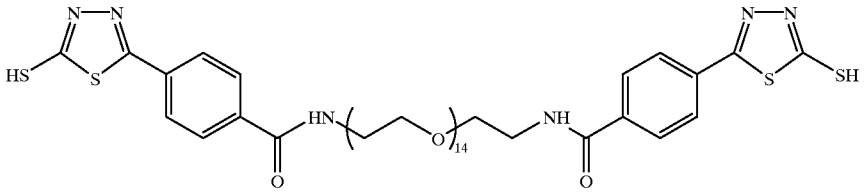

C30

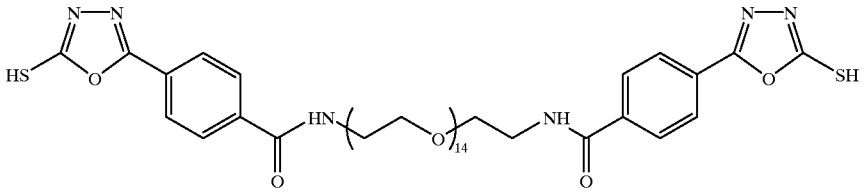

The color developing compositions useful in the practice of this invention include one or more color developing agents that are well known in the art that, in oxidized form, will react with dye forming color couplers in the processed materials. Such color developing agents include, but are not limited to, aminophenols, p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993). It may be useful for the color developing agents to have one or more water-solubilizing groups as are known in the art. Further details of such materials are provided in *Research Disclosure* (noted above, Section XIX.A).

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-p-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylene-diamine sesquisulfate, and others readily apparent to one skilled in the art.

In order to protect the color developing agents from oxidation, one or more antioxidants are generally included in the color developing compositions. Either inorganic or organic antioxidants can be used. Many classes of useful antioxidants are known, including but not limited to, sulfites (such as sodium sulfite, potassium sulfite, sodium bisulfite and potassium metabisulfite), hydroxylamine (and derivatives thereof), hydrazines, hydrazides, amino acids, ascorbic acid (and derivatives thereof), hydroxamic acids, arninoketones, mono- and polysaccharides, mono- and polyamines, quaternary ammonium salts, nitroxy radicals, alcohols, and oximes. Also useful as antioxidants are 1,4-cyclohexadiones as described in copending and commonly assigned U.S. Ser. No. 09/123,976 (filed Jul. 29, 1998 by Qiao and McGarry). Mixtures of compounds from the same or different classes of antioxidants can also be used if desired.

Especially useful antioxidants are hydroxylamine derivatives as described for example, in U.S. Pat. No. 4,892,804 (Vincent et al), U.S. Pat. No. 4,876,174 (Ishikawa et al), U.S. Pat. No. 5,354,646 (Kobayashi et al), and U.S. Pat. No. 5,660,974 (Marrese et al), and U.S. Pat. No. 5,646,327 (Burns et al), the disclosures of which are all incorporated herein by reference. Many of these antioxidants are mono- and dialkylhydroxylamines having one or more substituents on one or both alkyl groups. Particularly useful alkyl substituents include sulfo, carboxy, amino, sulfonamnido, carbonamido, hydroxy and other solubilizing groups.

More preferably, the noted hydroxylamine derivatives can be mono- or dialkylhydroxylamines having one or more hydroxy substituents on the one or more alkyl groups. Representative compounds of this type are described for example in U.S. Pat. No. 5,709,982 (Narrese et al), incorporated herein by reference, as having the structure IV:

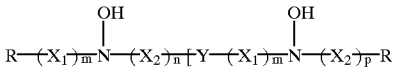

wherein R is hydrogen, a substituted or unsubstituted alkyl group of 1 to 10 carbon atoms, a substituted or unsubstituted hydroxyalkyl group of 1 to 10 carbon atoms, a substituted or unsubstituted cycloalkyl group of 5 to 10 carbon atoms, or a substituted or unsubstituted aryl group having 6 to 10 carbon atoms in the aromatic nucleus.

$X_1$ is —$CR_2(OH)CBR_1$ — and $X_2$ is —$CHRICR_2(OH)$— wherein $R_1$ and $R_2$ are independently hydrogen, hydroxy, a substituted or unsubstituted alkyl group or 1 or 2 carbon atoms, a substituted or unsubstituted hydroxyalkyl group of 1 or 2 carbon atoms, or $R_1$ and $R_2$ together represent the carbon atoms necessary to complete a substituted or unsubstituted 5- to 8-membered saturated or unsaturated carbocyclic ring structure.

Y is a substituted or unsubstituted alkylene group having at least 4 carbon atoms, and has an even number of carbon atoms, or Y is a substituted or unsubstituted divalent aliphatic group having an even total number of carbon and oxygen atoms in the chain, provided that the aliphatic group has a least 4 atoms in the chain.

Also in Structure IV, m, n and p are independently 0 or 1. Preferably, each of m and n is 1, and p is 0.

Specific di-substituted hydroxylamine antioxidants include, but are not limited to: N,N-bis(2,3-dihydroxypropyl)hydroxylamine, N,N-bis(2-methyl-2,3-dihydroxypropyl)hydroxylamine and N,N-bis(1-hydroxymethyl-2-hydroxy-3-phenylpropyl)hydroxylamine. The first compound is preferred.

Many of the noted antioxidants (organic or inorganic) are either commercially available or prepared using starting materials and procedures described in the references noted above in describing hydroxylamines.

Buffering agents are generally present in the color developing compositions to provide or maintain desired alkaline pH of from about 7 to about 13, and preferably from about 8 to about 12. Such useful buffering agents include, but are not limited to, carbonates, borates, tetraborates, glycine salts, triethanolamine, diethanolanrine, phosphates and hydroxybenzoates. Alkali metal carbonates (such as sodium carbonate, sodium bicarbonate and potassium carbonate) are preferred. Mixtures of buffering agents can be used if desired.

In addition to buffering agents, pH can also be raised or lowered to a desired value using one or more acids or bases. It may be particularly desirable to raise the pH by adding a base, such as a hydroxide (for example sodium hydroxide or potassium hydroxide).

The color developing compositions can also include one or more of a variety of other addenda that are commonly used in color developing compositions, including alkali metal halides (such as potassium chloride, potassium bromide, sodium bromide and sodium iodide), metal sequestering compositions (such as polycarboxylic or aminopolycarboxylic acids or polyphosphonates with lithium, magnesium or other small cations), antifoggants, development accelerators, glycols, alcohols, optical brighteners (such as triazinylstilbene compounds), wetting agents, fragrances, stain reducing agents, surfactants, defoaming agents, and water-soluble or water-dispersible color couplers, as would be readily understood by one skilled in the art [see for example, *Research Disclosure*, noted above]. The useful and optimal amounts of such additives are well known in the art also. Representative color developing compositions useful in the practice of this invention are described below in Example 1.

The color developing composition can be provided as a single- or multi-part composition, and can be supplied as a liquid or solid component of a photographic processing list.

The following TABLE I shows the general and preferred amounts of essential components of the color developing compositions. The preferred ranges are listed in parentheses (), and all of the ranges are considered to be approximate or "about" in the upper and lower end points. During color development, the actual concentrations can vary depending upon extracted chemicals in the composition, replenishment rates, water losses due to evaporation and carryover from any preceding processing bath and carryover to the next processing bath.

TABLE I

| COMPONENT | CONCENTRATIONS |
|---|---|
| Color developing agent | 1–45 mmol/l<br>(4.5–22 mmol/l) |
| Antioxidant | 2–90 mmol/l<br>(20–45 mmol/l) |
| Selectively diffusible photochemical | 0.05–50 mmol/l<br>(0.2–5 mmol/l) |
| Buffering agent | 36–420 mmol/l<br>(100–300 mmol/l) |

The color developing compositions described herein have utility to provide color development in an imagewise exposed color photographic elements comprising a support and one or more silver halide emulsion layers containing an imagewise distribution of developable silver halide emulsion grains. A wide variety of types of color photographic elements containing various types of emulsions can be processed using the present invention, the types of elements being well known in the art (see Research Disclosure, noted above). In particular, the invention can be used to process color photographic papers of all types of emulsions including so-called "high chloride" and "low chloride" type emulsions, and so-called tabular grain emulsions as well.

The present invention is particularly useful to process high chloride (greater than 70 mole % chloride and preferably greater than 90 mole % chloride, based on total silver) emulsions in color photographic papers in a rapid fashion. Such color photographic papers can have any useful amount of silver coated in the one or more emulsions layers, and in some embodiments, low silver (that is, less than about 0.8 g silver/$m^2$ and preferably less than 0.6 g silver/$m^2$) elements are processed with the present invention. The layers of the photographic elements can have any useful binder material or vehicle as it known in the art, including various gelatins and other colloidal materials.

Color development of an imagewise exposed photographic silver halide paper is carried out by contacting the element with a color developing composition prepared according to this invention under suitable rapid time and temperature conditions, in suitable processing equipment, to produce the desired developed image. Additional processing steps can then be carried out using conventional procedures, including but not limited to, one or more development stop, bleaching, fixing, bleach/fixing, washing (or rinsing) and drying steps, in any particular desired order as would be known in the art. Useful processing steps, conditions and materials useful therefor are well known for the various processing protocols steps (other than color development) including the conventional Process RA-4 (see for example, *Research Disclosure*, noted above, and the references noted therein, and U.S. Pat. No. 4,892,804, also noted above.

The photographic elements processed in the practice of this invention can be single or multilayer color elements. Multilayer color photographic elements typically contain dye image-forming color records sensitive to each of the three primary regions of the visible spectrum. Each color record can be comprised of a single emulsion layer or multiple emulsion layers sensitive to a given region of the spectrum. The layers of the element can be arranged in any of the various orders known in the art. The elements can also contain other conventional layers such as filter layers, interlayers, subbing layers, overcoats and other layers readily apparent to one skilled in the art. A magnetic backing can be included on the backside of conventional supports.

For conventional photographic color papers, the blue-sensitive color record is closest to the support, the green-sensitive color record is in the middle of the material, and the red-sensitive color record is the outermost color record.

Considerably more details of the photographic elements, including color paper structure and components, are described in *Research Disclosure*, noted above. Included within such teachings in the art is the use of various classes of cyan, yellow and magenta color couplers that can be used with the present invention (including pyrazolone type magenta dye forming couplers). Such papers generally have pigmented resin-coated paper supports which are prepared with the usual internal and external sizing agents (including alkylketene dimers and higher fatty acids), strengthening agents and other known paper additives and coatings.

The color developing compositions described herein can also be used in what are known as redox amplification processes, as described for example, in U.S. Pat. No. 5,723,268 (Fyson) and U.S. Pat. No. 5,702,873 (Twist).

Processing according to the present invention can be carried out using conventional deep tanks holding processing solutions. Alternatively, it can be carried out using what is known in the art as "low volume thin tank" processing systems, or LVTT, which have either a rack and tank or automatic tray design. Such processing methods and equipment are described, for example, in U.S. Pat. No. 5,436,118 (Carli et al) and publications noted therein.

Color development is generally followed by a bleaching and fixing, or bleach/fixing step using a suitable silver bleaching agent to desilver the color developed photographic element. Numerous bleaching agents are known in the art, including hydrogen peroxide and other peracid compounds, persulfates, periodates and ferric ion salts or complexes with polycarboxylic acid chelating ligands. Particularly useful chelating ligands include conventional polyaminopolycarboxylic acids including ethylenediaminetetraacetic acid and others described in *Research Disclosure*, noted above, U.S. Pat. No. 5,582,958 (Buchanan et al) and U.S. Pat. No. 5,753,423 (Buongiorne et al). Biodegradable chelating ligands are also desirable because the impact on the environment is reduced. Useful biodegradable chelating ligands include, but are not limited to, iminodiacetic acid or an alkyliminodiacetic acid (such as methyliminodiacetic acid), ethylenediaminedisuccinic acid and similar compounds as described in EP-A-0 532,003, and ethylenediamine monosuccinic acid and similar compounds as described in U.S. Pat. No. 5,691,120 (Wilson et al), or any mixture thereof.

The processing time and temperature used for each processing step (except color development) of the present invention are generally those conventionally used in the art. Color development is generally carried out at a temperature of from about 20 to about 60° C. (preferably from about 30 to about 45° C. The overall color development time is generally at least 10 seconds, and preferably at least 12 seconds, and generally up to 25 seconds, and preferably up to 20 seconds.

The following examples are provided for illustrative purposes only and are not intended to be limiting in any way. Unless otherwise indicated, all percentages are by weight.

COMPARATIVE EXAMPLE 1

The developing composition (D1) shown in TABLE II below provides a shorter color development time for KODAK EKTACOLOR EDGE 5 Color Paper compared with color development achieved using the conventional color developing composition, EKTACOLOR RA-Prime Developer. Processing was carried out as shown in TABLE III below.

TABLE II

| Component | Composition |
|---|---|
| Pentasodium salt of diethylenetriaminepentaacetic acid (40% solution) | 9.6 m/l |
| Potassium carbonate | 33 g/l |
| Sodium salt of p-toluene sulfonic acid | 20 g/l |
| Polyethylene glycol 4000 | 10 g/l |
| N-isopropyl-N-(2-sulfoethyl)hydroxylamine | 8.0 g/l |
| BLANKOPHOR REU ® optical brightener | 2.0 g/l |
| Potassium chloride | 4.0 g/l |
| KODAK Color Developing Agent CD-3 | 8 g/l |
| Triazolium thiolate* | 0.1 g/l |
| pH | 10.0 |
| Temperature | 41° C. |

*4-carboxyethyl-2,3-dimethyl-1,2,4-triazolium-5-thiolate

TABLE III

| Normal Process cycle | | Short Process cycle | |
|---|---|---|---|
| Developer RA-Prime | 45 seconds | Developer (D1) | 12, 14 or 16 seconds |
| Bleach-fix | 45 seconds | Bleach-fix | 45 seconds |
| Wash | 2 minutes | Wash | 2 minutes |

Bleach-fixing using KODAK EKTACOLOR RA4 Bleach-Fix

In order to lower the red and green color record contrast, shoulder and Dmax in the short process cycle outlined above, a commonly used development inhibitor (see Mason, Photographic Processing Chemistry, p. 40, Focal Press) was added to the Developer DI shown in TABLE II. The range of concentrations of this inhibitor, 5-methylbenzotriazole (BTAZ) was as follows; 0, 5, 20 and 100 mg/i (0, 0.037 mmol/l, 0.15 mmol/l and 0.75 mmol/l) was used, and the sensitometric response measured. The results for a 12 second color development time are shown in TABLE IV.

TABLE IV

| BTAZ (mg/l) | 0 | 5 | 20 | 100 | RA-ref |
|---|---|---|---|---|---|
| Red Dmax | 2.953 | 2.908 | 2.547 | 0.974 | 2.629 |
| Green Dmax | 2.821 | 2.792 | 2.398 | 0.632 | 2.649 |
| Blue Dmax | 2.266 | 1.997 | 1.326 | 0.407 | 2.468 |
| Red Dmin | 0.116 | 0.11 | 0.105 | 0.103 | 0.105 |
| Green Dmin | 0.117 | 0.104 | 0.103 | 0.103 | 0.097 |
| Blue Dmin | 0.125 | 0.115 | 0.104 | 0.102 | 0.11 |
| Red speed | 141.7 | 137.1 | 110.6 | | 129.6 |
| Green speed | 130.2 | 125 | 96.2 | | 122.8 |
| Blue speed | 126.1 | 116.9 | 61.3 | | 123.1 |
| Red contrast | 4.188 | 3.928 | 2.646 | 0.845 | 3.265 |
| Green contrast | 3.411 | 3.403 | 2.945 | 0.585 | 3.241 |
| Blue contrast | 3.068 | 2.343 | 1.29 | 0.31 | 3.325 |
| Red shoulder | 2.196 | 2.126 | 1.775 | | 1.937 |
| Green shoulder | 1.996 | 1.992 | 1.804 | | 1.95 |
| Blue shoulder | 1.787 | 1.53 | 1.198 | | 1.928 |
| Red toe | 0.349 | 0.336 | 0.37 | | 0.325 |
| Green toe | 0.364 | 0.343 | 0.385 | | 0.314 |
| Blue toe | 0.341 | 0.369 | 0.669 | | 0.295 |

It can be seen from TABLE IV that 5-methyl benzotriazole is effective in lowering red- and green-sensitive color record response as required and a level between 5 and 20 mg/liter will bring these responses close to the aim response listed under RA-ref. At the same time however the blue-sensitive color record response is inhibited even more than the red- and green-sensitive color records, even at the lowest level of 5-methyl benzotriazole. This is not desired because the blue-sensitive color record response is already underactive in the short process and now in the presence of a commonly used inhibitor gives even more unacceptable sensitometry.

This example shows that a commonly used inhibitor of low molecular weight cannot correct the overactivity in the red- and green-sensitive color records without also severely upsetting the blue-sensitive color record response and giving unsatisfactory performance in the short process. This is because it is able to diffuse through the coated layers and still reach the bottom or blue-sensitive color record even in the short development time of 12 seconds. Other materials commonly used as inhibitors and restrainers such as 6-nitrobenzimidazole, 1- phenyl-5mercaptotetrazole, potassium bromide and iodide behaved in the same way as 5-methylbenzotriazole again because they can diffuse rapidly into the layers. Thus some other way to restore the color balance by lowering red- and green-sensitive color record activity without inhibiting blue-sensitive color record activity is needed. This is the problem which was previously unrecognized until color paper originally designed for a 45 second developer was processed in a much shorter time. This problem is solved by the present invention.

EXAMPLE 1

The color developing composition (D1) described in TABLE II was used with the process cycle described in TABLEI m as the "Short Process Cycle". A development time of 12 seconds was used to process KODAK EKTACOLOR® EDGE 7 Color Paper. The selectively diffusible development inhibitor identified as Compound Cl was included in the color developing composition. The effect on color contrast is shown in TABLE V below.

TABLE V

| C1 (g/l) | Red | Green | Blue |
|---|---|---|---|
| 0 | 3.62 | 2.92 | 1.81 |
| 0.5 (0.52 mmol/l) | 2.52 | 2.69 | 1.78 |
| % change | −30 | −7.9 | −1.66 |

It can be seen that red-sensitive color record contrast is lowered by 30%, the green-sensitive color record contrast is lowered by 7.9% and the blue-sensitive color record contrast is almost unchanged. This effect is just what is required in order to correct the color imbalance exhibited in the rapid process.

The effects of the use of Compound Cl on the shoulder density of the sensitometric curves are shown in FIG. 1 (Curve A is for the red-sensitive color record, Curve B is for the green-sensitive color record, and Curve C is for the blue-sensitive color record). In this diagram it can be seen that at low levels there is no significant effect of Compound Cl but at 0.5 g/l there is an inhibition of the red-sensitive color record with only a small effect on the green- and blue-sensitive color records. This is the desired effect.

EXAMPLE 2

In this example, color developing composition D2 was used to which Compound Cl was added at 0.3 or 0.5 g/l (0.31 or 0.52 mmol/l).

TABLE VI

| Component | Composition |
|---|---|
| Pentasodium salt of diethylenetriaminepentaacetic acid (40% solution) | 9.6 ml/l |
| Potassium carbonate | 50 g/l |
| Sodium salt of p-toluene sulfonic acid | 20 g/l |
| N-isopropyl-N-(2-sulfoethyl)hydroxylamine | 8.0 g/l |
| BLANKOPHOR REU ® optical brightener | 2.0 g/l |
| Potassium chloride | 1.9 g/l |
| KODAK Color Developing Agent CD-3 | 8 g/l |
| pH | 10.6 |
| Temperature | 42° C. |

Figure 2:
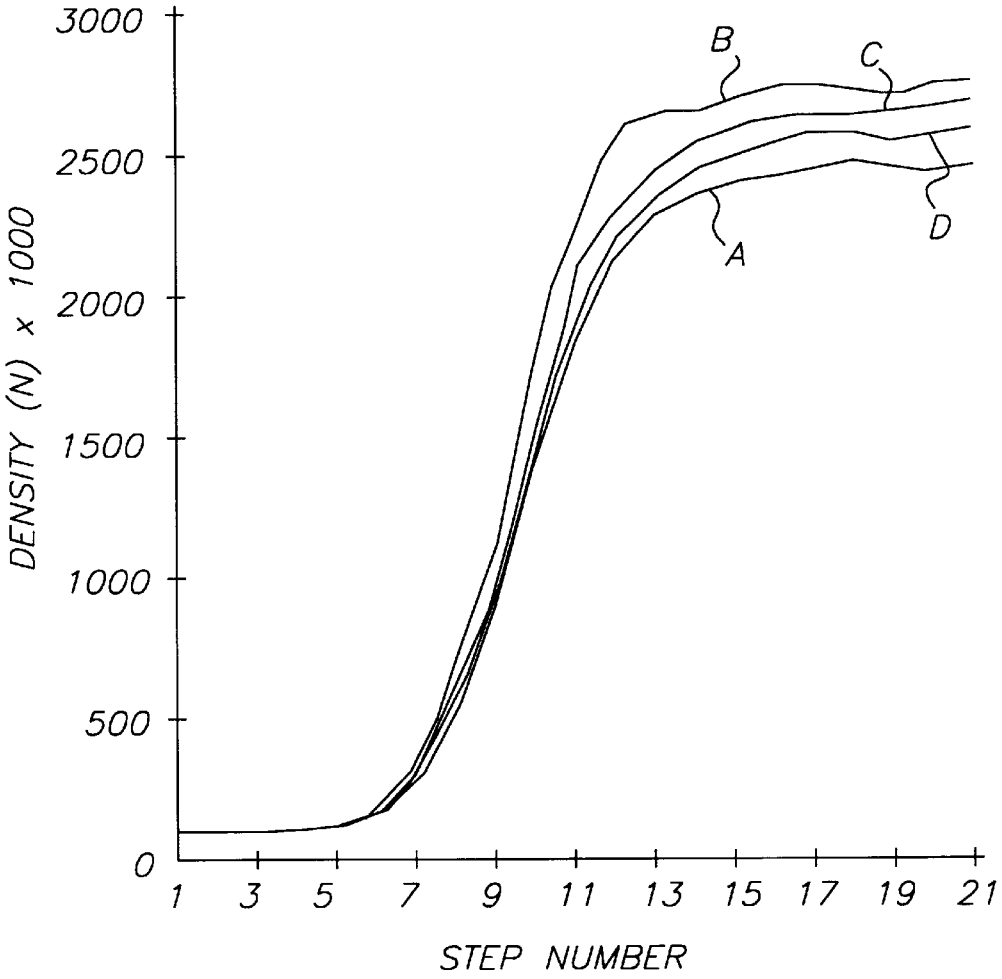
FIG. 2 is a graphical plot of sensitometric results in the red-sensitive color record of the processed color papers as described in Example 2 below.

The sensitometric results achieved using developing composition D2 for a 14 second color development time to process KODAK EKTACOLOR® EDGE 7 Color Paper are shown in FIG. 2 for the red-sensitive color record where Curve A is for the EKTACOLOR RA4 reference process and the other curves are for the rapid process (Curve B for 0 g/l Cl, Curve C for 0.3 g/l Cl, and Curve D for 0.5 g/l Cl). It can be seen that in the absence of Cl the red-sensitive color record is overactive. As the level of Cl was increased, the sensitometric curves were closer to the aim reference curve.

Figure 3:
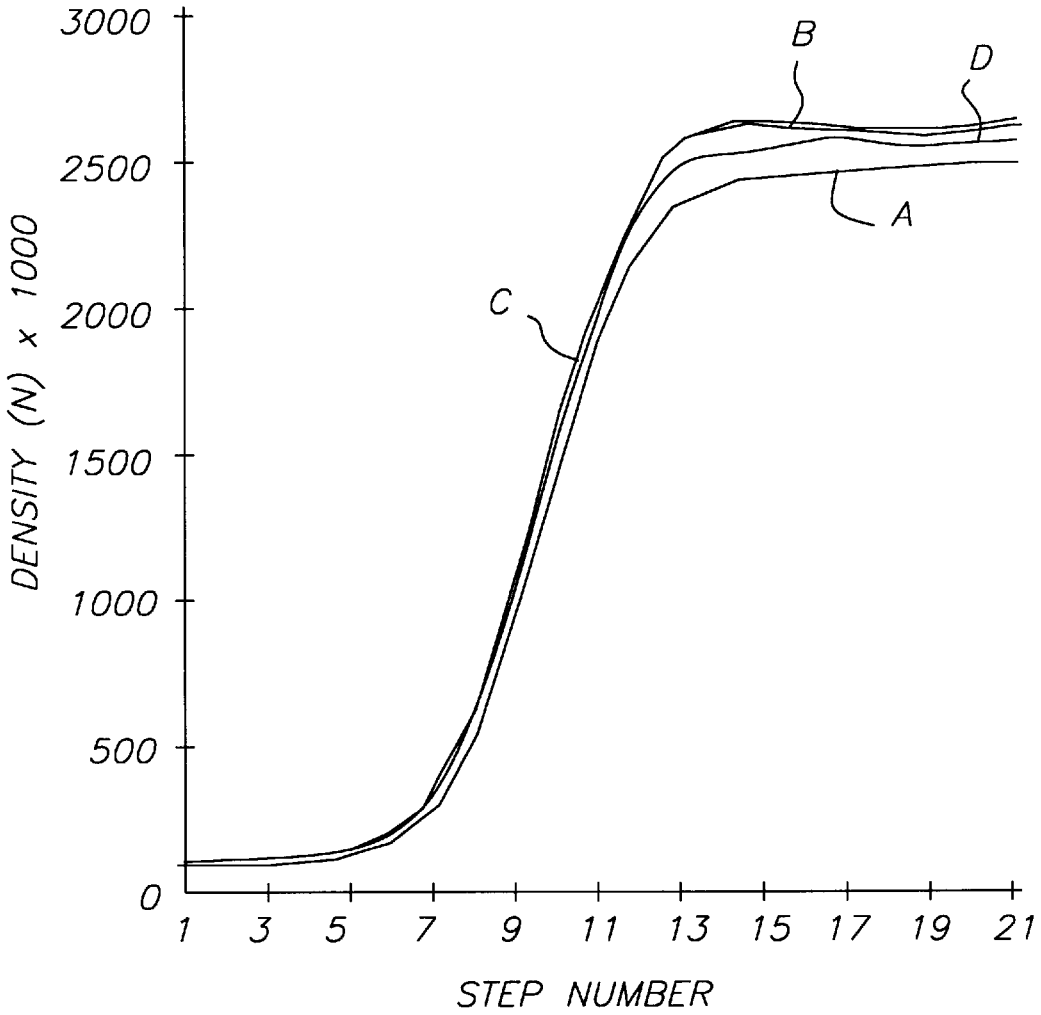
FIG. 3 is a graphical plot of sensitometric results in the green-sensitive color record as described in Example 2 below.

Similar results are shown in FIG. 3 for the green-sensitive color record. Curve A is the EKTACOLOR RA4 reference process and the other curves are for the 14 second rapid process (Curve B for 0 g/l Cl, Curve C for 0.3 g/l Cl, and Curve D for 0.5 g/l Cl).

Figure 4:
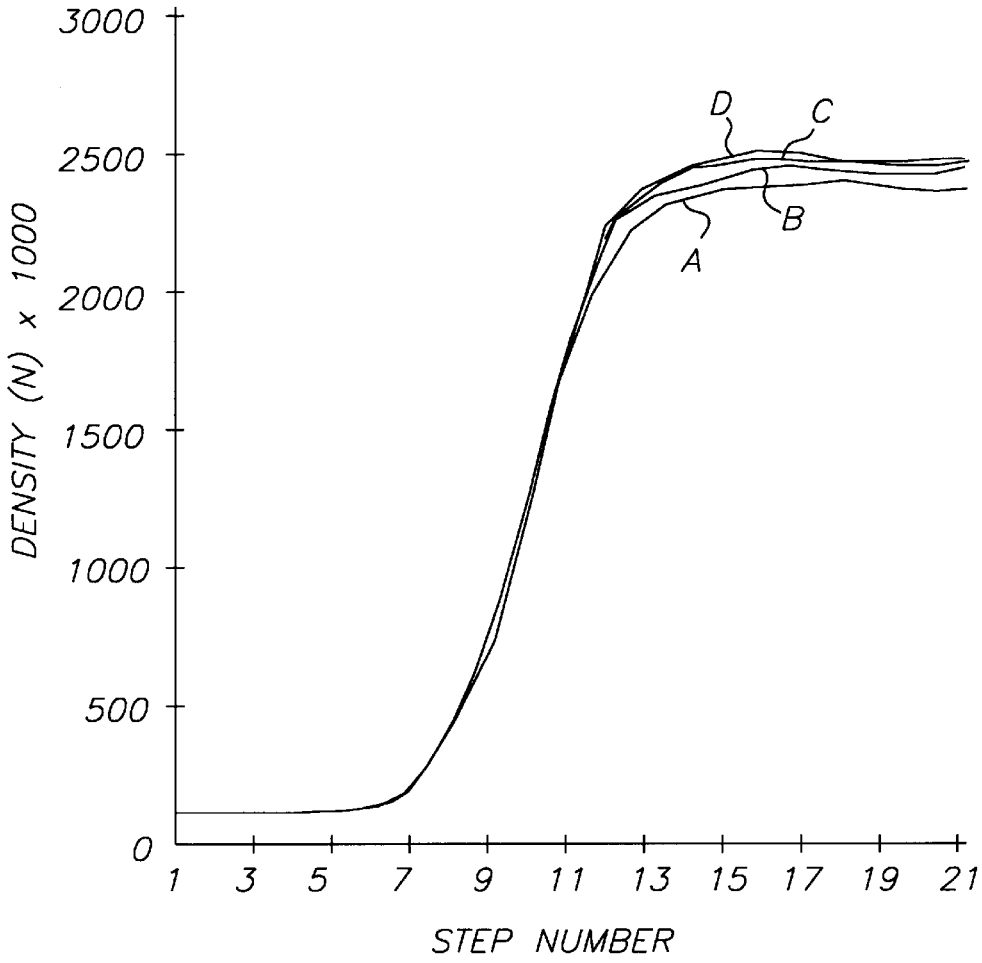
FIG. 4 is a graphical plot of sensitometric results in the blue-sensitive color record as described in Example 2 below.

FIG. 4 shows the results for the blue-sensitive color record. Curve A is for the RA4 reference process, and the other curves are for the 14 second rapid process (Curve B for 0 g/l Cl, Curve C for 0.3 g/l Cl, and Curve D for 0.5 g/l Cl).

In both FIGS. 3 and 4, the curves for the rapid process are quite close to the aim RA4 reference curves even in the absence of Cl and they are not significantly affected by addition of Cl to the color developing composition.

The over-active sensitometry in the red-sensitive color record of color papers designed for the normal 45 second process was previously unrecognized and causes color imbalance in the rapid process. The data shown above clearly demonstrate that the present invention can correct this problem by making use of a suitable selectively diffusible development inhibitor that can only diffuse into the red-sensitive color record of a multilayer coating and consequently only inhibits development in that color record with almost no effect on underlying color records.

The invention has been described in detail with particular reference to preferred embodiments thereof, but it will be understood that variations and modifications can be effected within the spirit and scope of the invention.

We claim:

1. A method of forming a color photographic image comprising:

A) contacting an imagewise exposed color silver halide photographic element with a color developing composition comprising a color developing agent, and a selectively diffusible color development photochemical at a concentration of at least 0.05 mmol/l, said contacting being for up to 25 seconds, said photographic element comprising a support having thereon a blue-sensitive photographic silver halide emulsion layer, a green-sensitive photographic silver halide emulsion layer, and a red-sensitive photographic silver halide emulsion layer, the selectively diffusible color development photochemical having a diffusibility such that during the contacting step, it diffuses predominantly within the outermost silver halide emulsion layer only.

2. The method of claim 1 wherein said contacting step is carried out within from about 10 to about 25 seconds.

3. The method of claim 2 wherein said contacting step is carried out within from about 12 to about 20 seconds.

4. The method of claim 1 wherein said selectively diffusible color development photochemical is a color development inhibitor, a color development accelerator or a color developing agent.

5. The method of claim 4 wherein said selectively diffusible color development photochemical is a development inhibitor represented by the structure II:

$$\text{INH—LG—LINK—(LG—INH)}_q \qquad \text{II}$$

wherein INH is derived from a heterocyclic compound having one or more nitrogen, sulfur, oxygen, selenium or tellurium atoms in its heterocyclic ring(s), or from a heterocyclic compound further comprising at least one exocyclic mercapto, seleno or telluro substituent or derivative thereof, LG is a chemical bond or group to bind INH to LINK, LINK is a monovalent to pentavalent aliphatic linking group, and q is 0to 4.

6. The method of claim 5 wherein INH is derived from a substituted or unsubstituted oxazole, diazole, triazole, oxadiazole, thiadiazole, oxathiazole, thiatriazole, benzotriazole, tetrazole, benzimidazole, indazole, isoindazole, mercaptotetrazole, selenotetrazole, mercaptobenzothiazole, selenobenzothiazole, mercaptobenzoxazole, selenobenzoxazole, mercaptobenzimidazole, selenobenzimidazole, benzodiazole, mercaptooxazole, mercaptothiadiazole, mercaptothiazole, mercaptotriazole, mercaptooxadiazole, mercaptodiazole, mercaptooxathiazole, tellurotetrazole or benzisodiazole, LINK comprises one or more alkylene groups connected by oxygen, nitrogen or sulfur atoms,and q is 0 or 1.

7. The method of claim 5 wherein INH is one of the following heterocyclyl groups:

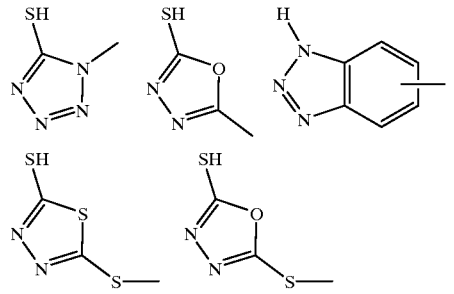

8. The method of claim 7 wherein LINK comprises one or more methylene or ethylene groups separated by one or more acyclic groups.

9. The method of claim 5 wherein said selectively diffusible development inhibitor is represented by structure III:

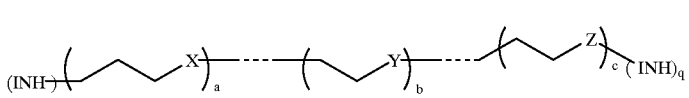

III wherein X, Y and Z are independently oxygen, nitrogen or sulfur atoms, and the sum of a, b and c is from 3 to 33.

10. The method of claim 9 wherein X, Y and Z are each oxygen, and the sum of a, b and c is from 10 to 20.

11. The method of claim 10 wherein the sum of a, b and c is 14.

12. The method of claim 5 wherein said development inhibitor is

C1
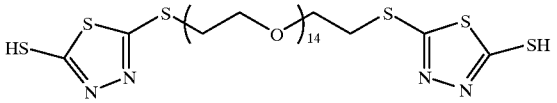
C2
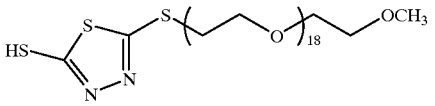
C3
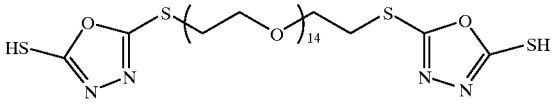
C4
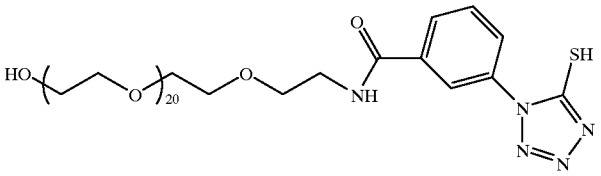
C5
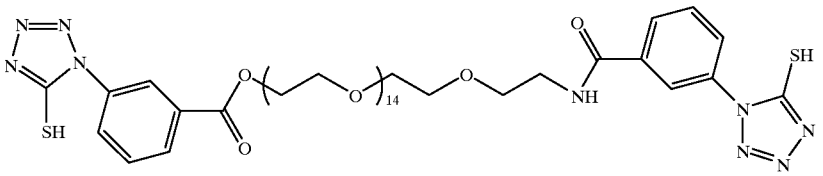
C6
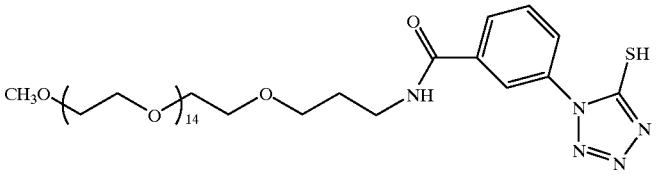
C7
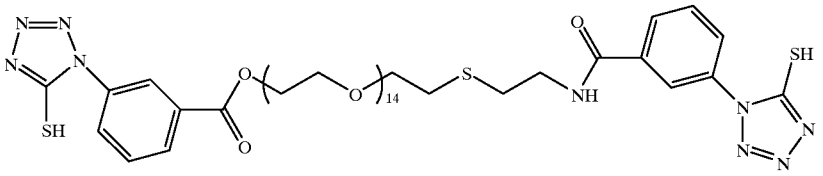
C8
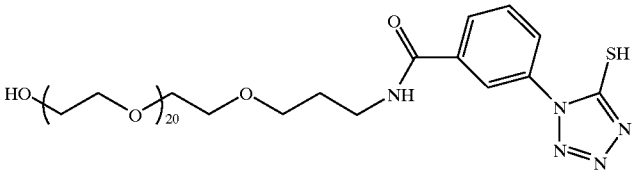
C9
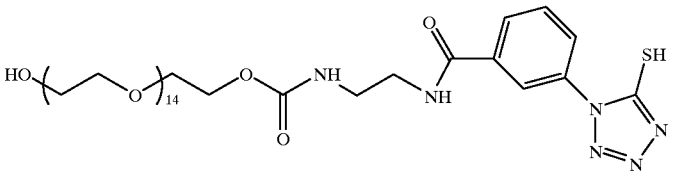

-continued
C10
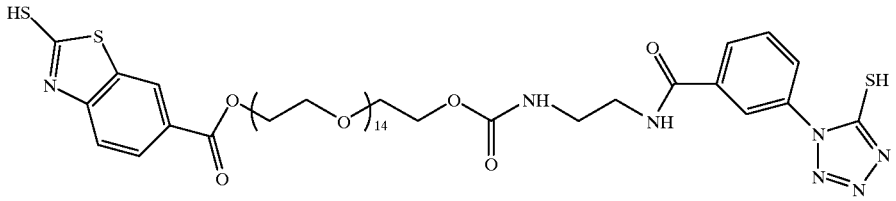
C11
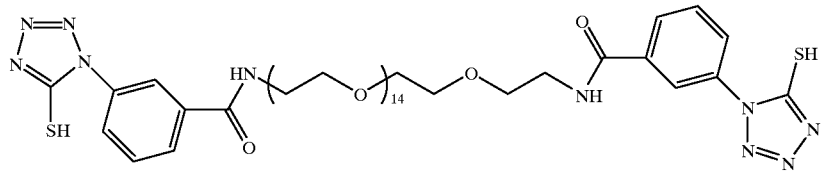
C12
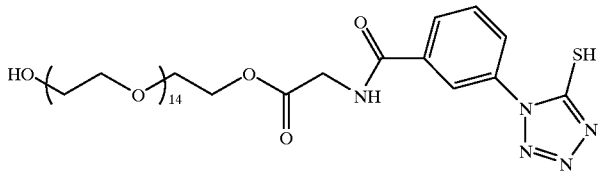
C13
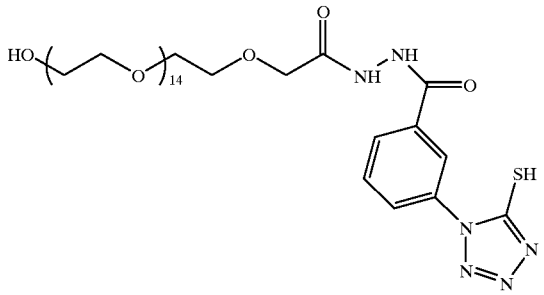
C14
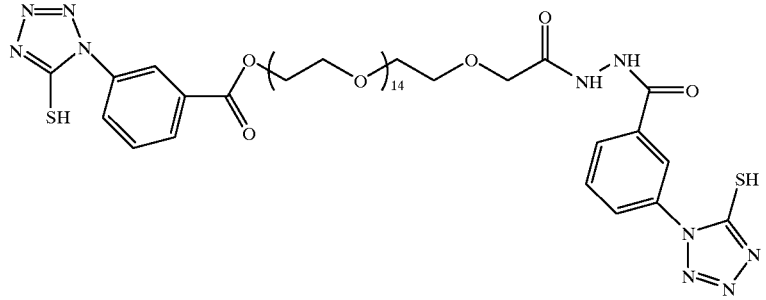
C15
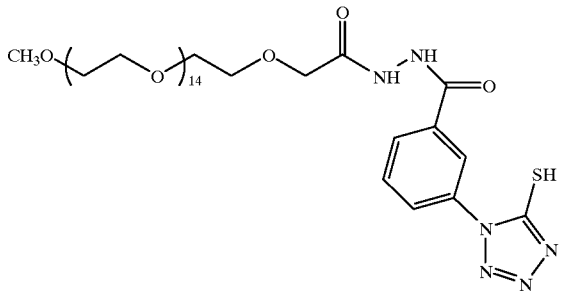

-continued
C16
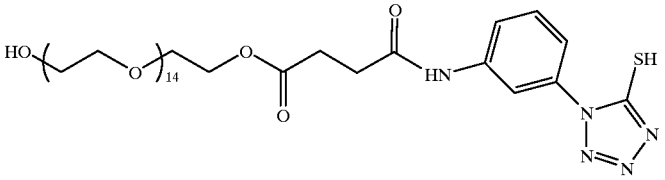
C17
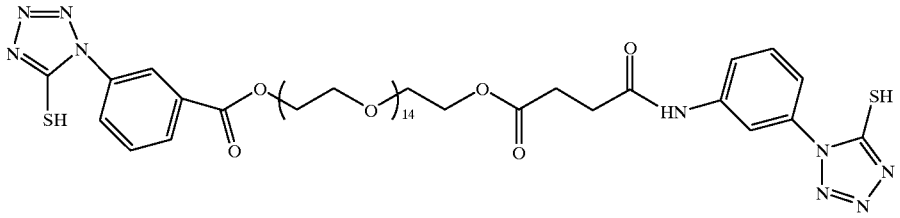
C18
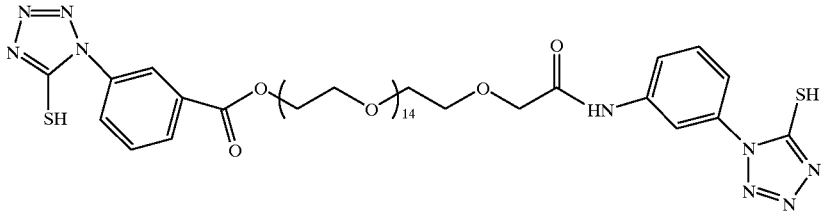
C19
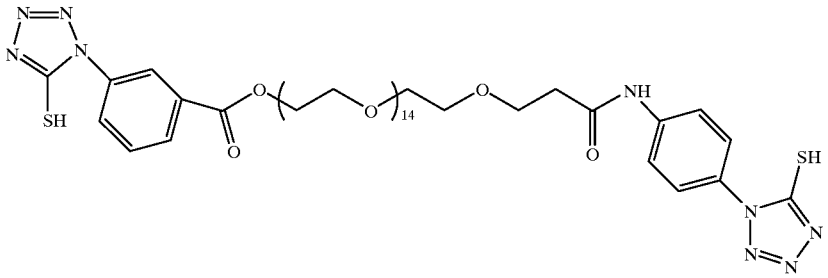
C20
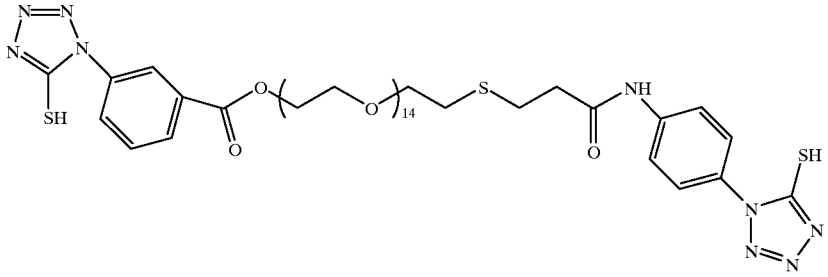
C21
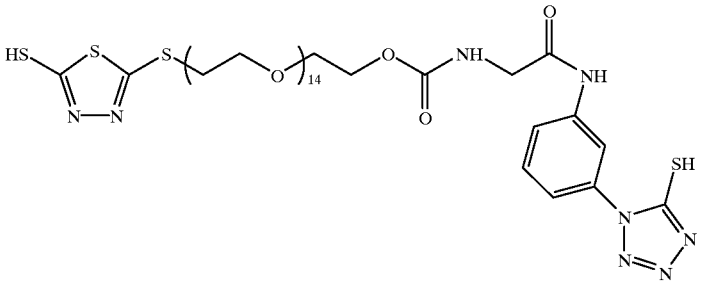

-continued
C22
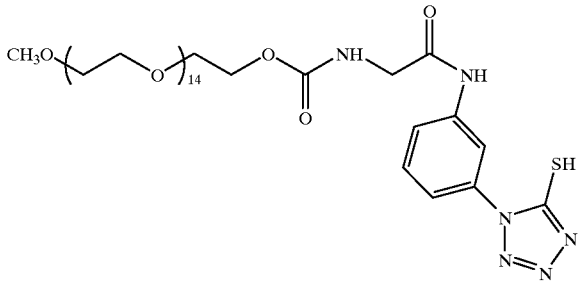
C23
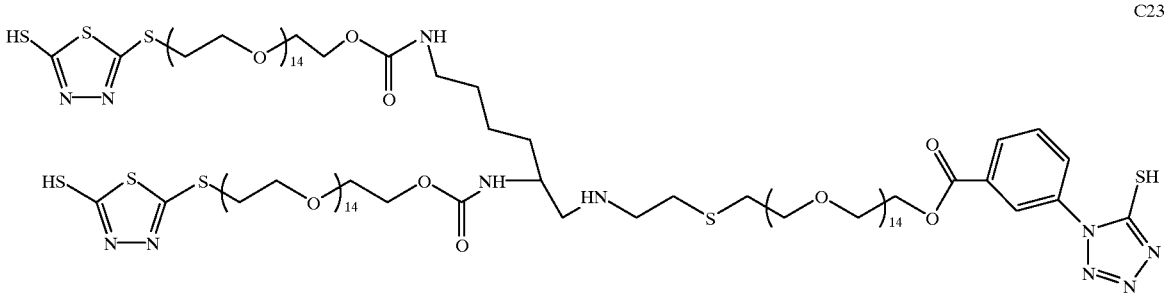
C24
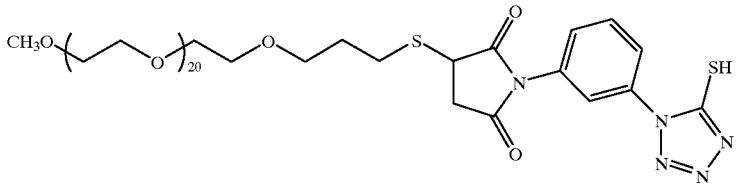
C25
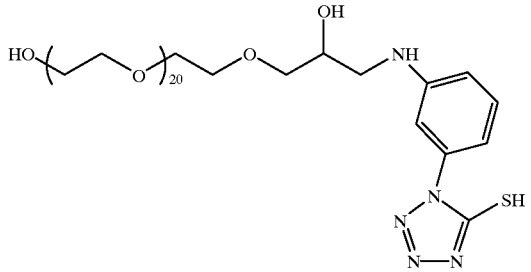
C26
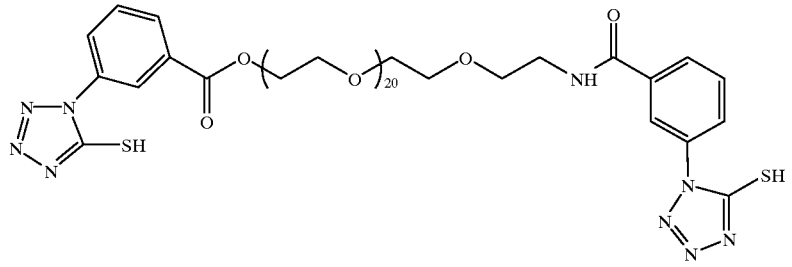
C27
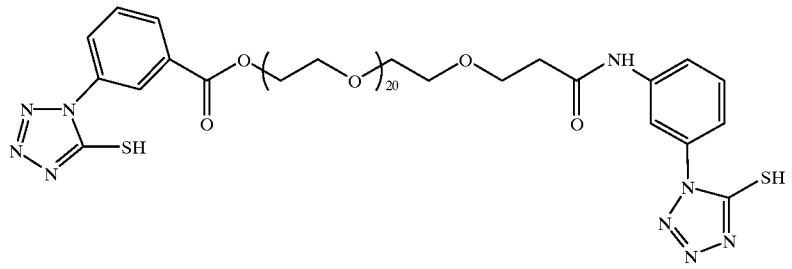

-continued

C28

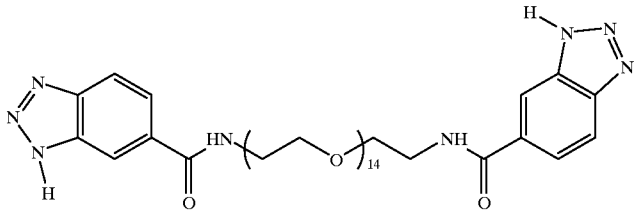

C29

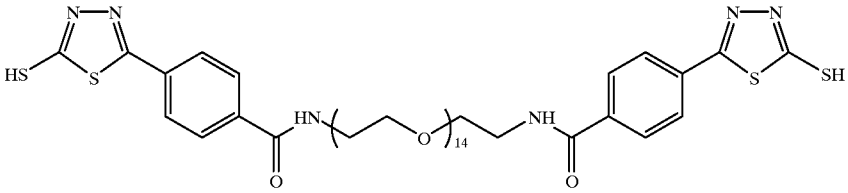

C30

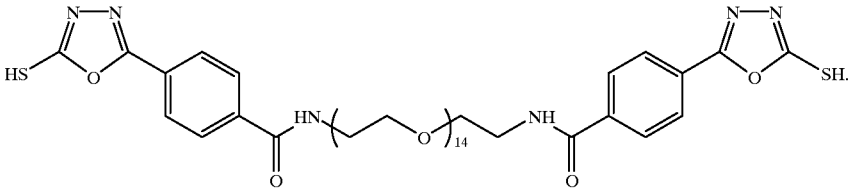

13. The method of claim 1 wherein said color developing agent is present in said color developing composition at a concentration of from about 1 to about 45 mmol/l, and said selectively diffusible color development photochemical is present at a concentration of from about 0.05 to about 50 mmol/l.

14. The method of claim 13 wherein said selectively diffusible color development photochemical is a color development inhibitor.

15. The method of claim 1 wherein said color developing composition further comprises an organic antioxidant in an amount of from about 2 to about 90 mmol/l.

16. The method of claim 15 wherein said color developing composition comprises a hydroxylamine antioxidant.

17. The method of claim 16 wherein said color developing composition comprises a dialkylhydroxylamine that has at least one hydroxy, sulfo, carboxy, sulfonamido, sulfamoyl, carbonamido or carbamoyl group.

18. The method of claim 15 wherein said organic antioxidant is N,N-bis(2,3-dihydroxypropyl)hydroxylamine.

19. The method of claim 1 wherein said color silver halide photographic element is a photographic color paper having on said support, in order, said blue-sensitive photographic silver halide emulsion layer, said green-sensitive photographic silver halide emulsion layer, and said red-sensitive photographic silver halide emulsion layer, and said selectively diffusible color development photochemical diffuses predominantly within said red-sensitive photographic silver halide emulsion layer only, wherein desired color balance among all three silver halide emulsion layers is maintained.

20. A method of forming a color photographic image comprising:

A) contacting an imagewise exposed color silver halide photographic paper with a color developing composition comprising from about 1 to about 45 mmolul of 4-(N-ethyl-N-2-methanesulfonylaminoethyl)-2-methylphenylene-diamine sesquisulfate, from about 2 to about 90 mmol/l of N,N-bis(2,3-dihydroxypropyl) hydroxylamine, and from about 0.05 to about 50 mmol/l of the compound Cl

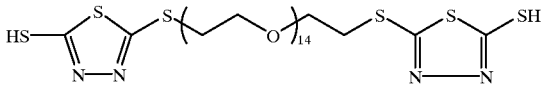

said contacting being for up to 25 seconds, said photographic paper comprising a support having thereon, in order, a blue-sensitive photographic silver halide emulsion layer, a green-sensitive photographic silver halide emulsion layer, and a red-sensitive photographic silver halide emulsion layer, the Compound Cl having a diffusibility such that during the contacting step, it diffuses predominantly within the red-sensitive photographic silver halide emulsion layer only, wherein desired color balance among all three silver halide emulsions layers is maintained.

* * * * *